US006971621B2

(12) United States Patent
Gaines

(10) Patent No.: US 6,971,621 B2
(45) Date of Patent: Dec. 6, 2005

(54) BOOK HOLDER ASSEMBLY

(76) Inventor: Ronald J. Gaines, 5807 Rushwood Dr., Dublin, OH (US) 43017

( * ) Notice: Subject to any disclaimer, the term of this patent is extended or adjusted under 35 U.S.C. 154(b) by 67 days.

(21) Appl. No.: 10/716,206

(22) Filed: Nov. 17, 2003

(65) Prior Publication Data

US 2005/0103969 A1 May 19, 2005

(51) Int. Cl.[7] ..... A47B 97/04; A47G 1/24
(52) U.S. Cl. ..... 248/447; 248/454; 248/459
(58) Field of Search ..... 248/441.1, 447, 248/451, 452, 453, 454, 459, 463; 281/33, 281/42, 34, 45, 46; 206/371, 214, 477, 482; 402/4, 73, 79; 24/10 R, 11 R

(56) References Cited

U.S. PATENT DOCUMENTS

| | | | | | |
|---|---|---|---|---|---|
| 264,623 | A | | 9/1882 | Bynon | |
| 290,381 | A | | 12/1883 | Wood | |
| 456,089 | A | | 7/1891 | Harrison | |
| 606,924 | A | | 7/1898 | Hale | |
| 1,203,659 | A | | 11/1916 | Smith | |
| 3,061,969 | A | | 11/1962 | Lunday | |
| 3,076,285 | A | | 2/1963 | Sparkman | |
| 3,381,928 | A | | 5/1968 | White | |
| 3,674,231 | A | | 7/1972 | Lewis | |
| 3,954,246 | A | | 5/1976 | Sparkman | |
| 3,981,522 | A | * | 9/1976 | Bloom | 281/34 |
| 4,463,854 | A | * | 8/1984 | MacKenzie | 211/43 |
| 4,712,760 | A | | 12/1987 | Winter | |
| 4,735,438 | A | | 4/1988 | Demarest | |
| 5,060,581 | A | * | 10/1991 | Malinski | 108/44 |
| 5,120,014 | A | | 6/1992 | Chou | |
| 5,161,771 | A | * | 11/1992 | Domeier | 248/676 |
| 5,678,943 | A | * | 10/1997 | Parsons | 402/79 |
| 5,718,023 | A | * | 2/1998 | Billish | 24/11 HC |
| 5,722,628 | A | * | 3/1998 | Menaged | 248/441.1 |
| 5,810,182 | A | * | 9/1998 | Levin | 211/195 |
| 5,829,787 | A | * | 11/1998 | Newhouse, Jr. | 281/46 |
| 5,855,329 | A | * | 1/1999 | Pagano | 248/451 |
| 5,908,207 | A | | 6/1999 | Wilson | |
| 5,979,857 | A | | 11/1999 | Holm | |
| 6,231,023 | B1 | * | 5/2001 | Morton | 248/441.1 |
| 6,499,767 | B1 | * | 12/2002 | Takemura | 281/33 |

FOREIGN PATENT DOCUMENTS

| | | | |
|---|---|---|---|
| EP | 0370961 | * | 5/1990 |

* cited by examiner

*Primary Examiner*—Anita King
*Assistant Examiner*—Tan Le
(74) *Attorney, Agent, or Firm*—Thomas S. Baker, Jr.

(57) ABSTRACT

The present invention is essentially comprised of a pair of spaced-apart planar book support elements joined by a hinged spine support element that accommodates the book spine, a pair of book holder slope support elements that are each joined by a hinge to the top edge of a respective book support element, and a closed cord loop element that adjustably co-operates with the lower extremes of each book support element and each slope support element to controllably vary the slope of the planar book support elements during reading use.

20 Claims, 3 Drawing Sheets

BOOK HOLDER ASSEMBLY

CROSS-REFERENCES

None.

FIELD OF THE INVENTION

The present invention relates generally to book holders, and particularly concerns a portable book holder assembly that may be used as a book carrier and also that may be positioned for use with a readily adjustable book holder reading slope.

BACKGROUND OF THE INVENTION

Many types of books, and especially soft cover or paper cover books, are difficult to maintain in a particular open position when being read unless the reader's hand or hands are available to maintain the desired open condition or unless an auxiliary mechanical device is utilized for the position maintenance task. While many different book holder constructions have been proposed for accomplishing the position maintenance task, those that are known are unnecessarily complex especially when relating to the construction features and procedural steps that are required to adjust or vary the slope of the book holder assembly for best ease of reading.

Accordingly, a principal object of the present invention is to provide a book holder construction that structurally is relatively simple and that may be readily adjusted to vary or change the slope of the assembly for ease of reading during use.

Another object of the present invention is to provide a book holder assembly that may additionally be utilized as a book carrier to transport the included book in its fully closed condition.

Other objects and advantages of the present book holder invention will become apparent from consideration of the several descriptions, drawings, and claims which follow.

SUMMARY OF THE INVENTION

The present invention is essentially comprised of a pair of spaced-apart planar book support elements joined by a hinged spine support element that accommodates the book spine, a pair of book holder slope support elements that are each joined by a hinge to the top edge of a respective book support element, and a closed cord loop element that adjustably co-operates with the lower extremes of each book support element and each slope support element to controllably vary the slope of the planar book support elements during reading use. The planar book support elements are each provided with a ledge element for supporting the lower edges of the book inserted in the book holder for reading. Ancillary book holder lamp and book holder clamp elements are optionally included in the book holder assembly.

DETAILED DESCRIPTION

Figure 1:
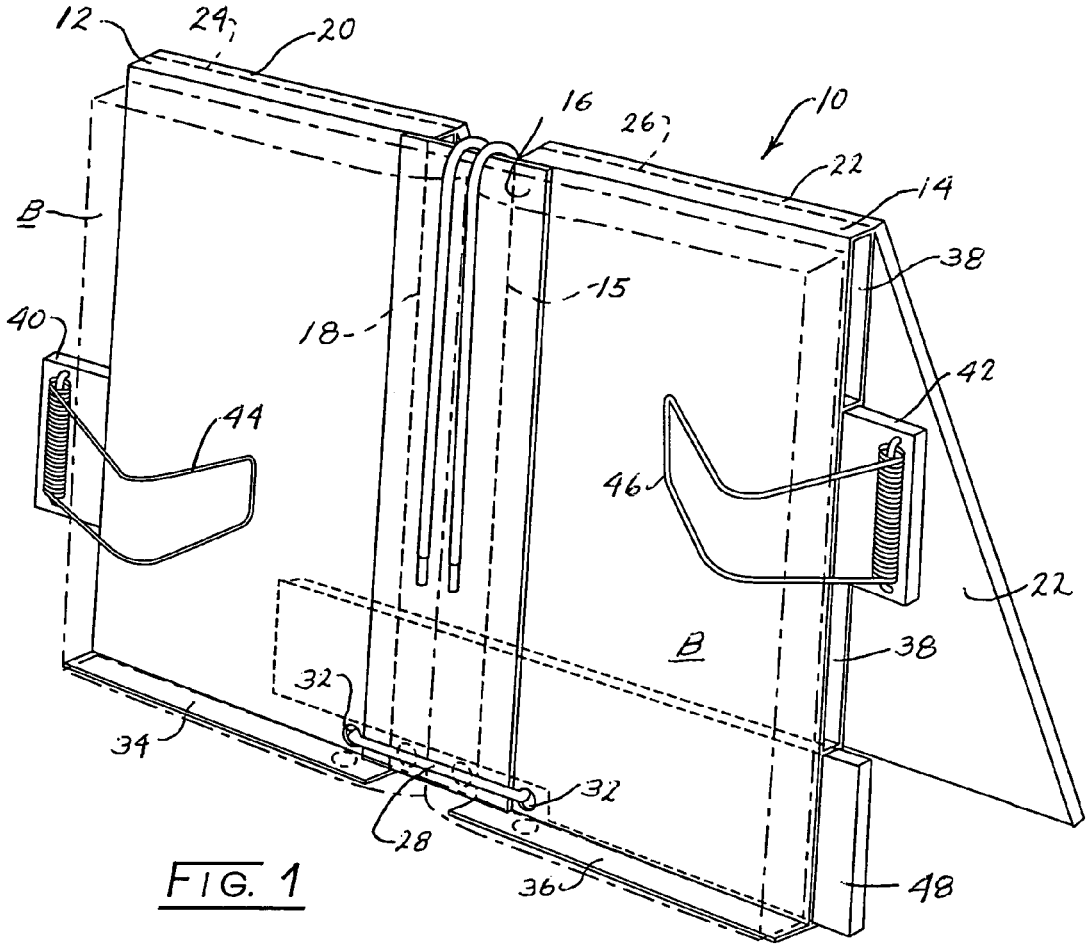
FIG. 1 is a schematic perspective elevation view of a preferred embodiment of the book holder assembly of the present invention in its commonly preferred use position.
Figure 2:
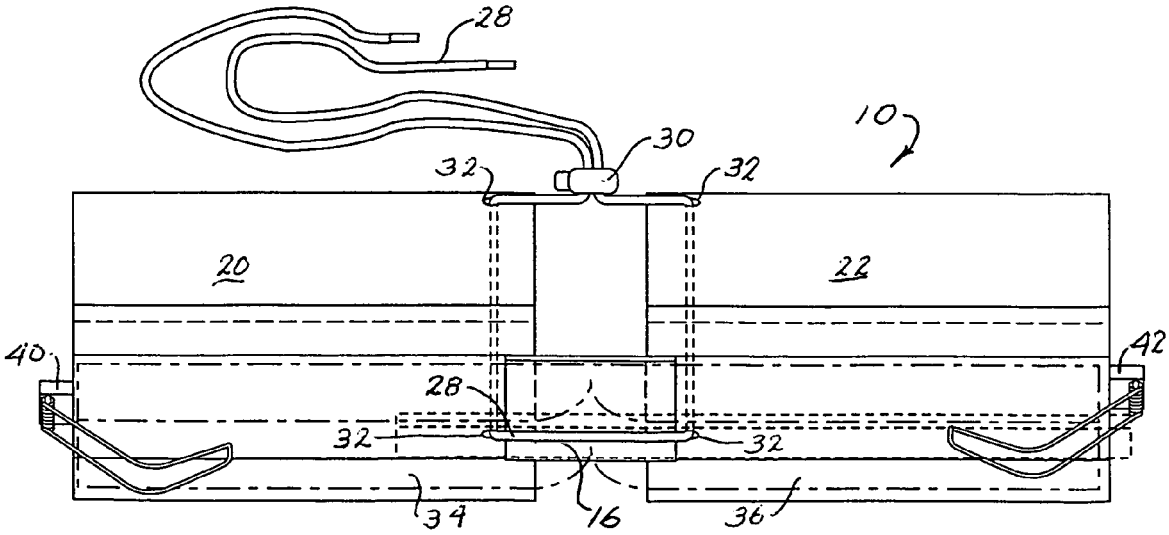
FIG. 2 is a plan view of the book holder assembly of FIG. 1.
Figure 3:
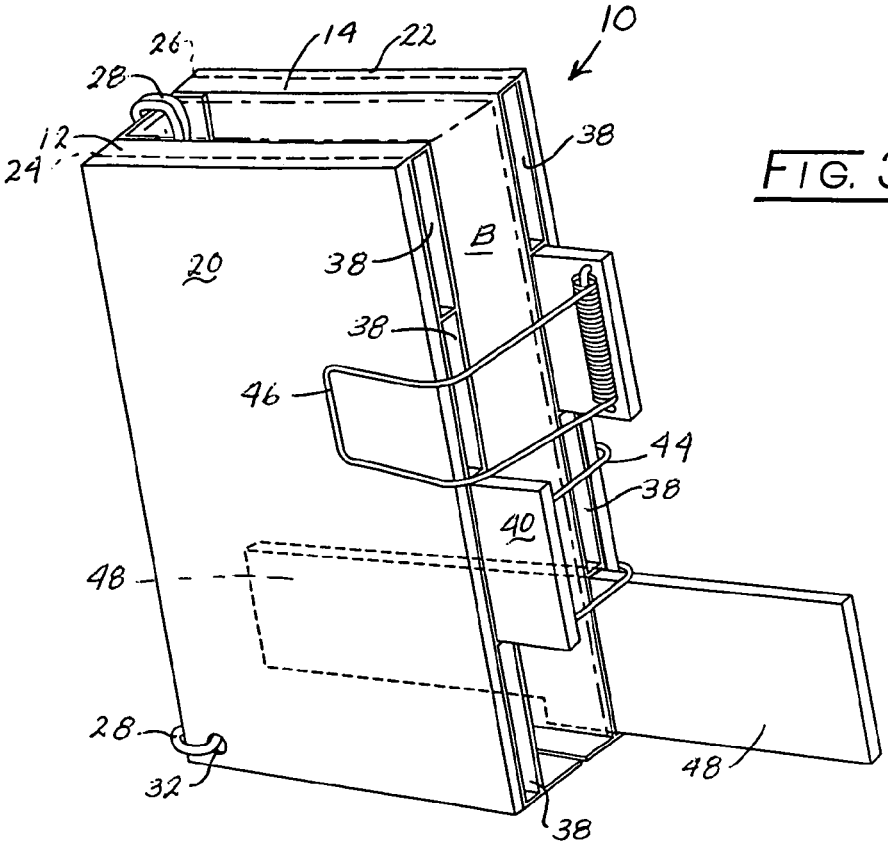
FIG. 3 is a schematic perspective view of the book holder assembly of FIG. 1 in its pre-use and folded carrying condition.
Figure 4:
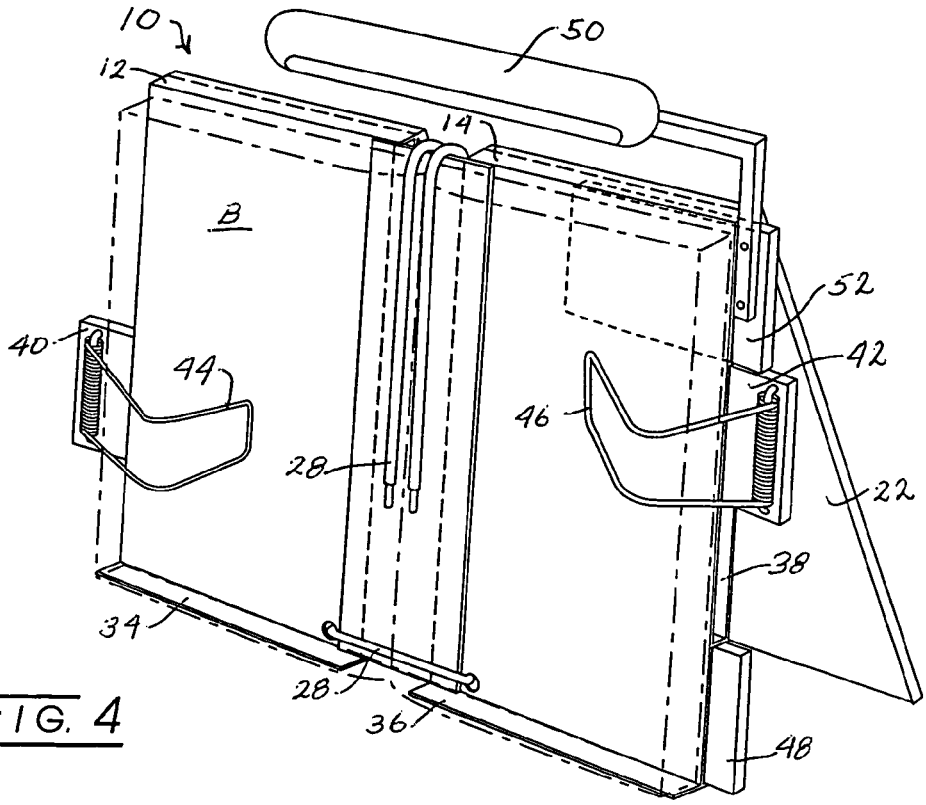
FIG. 4 is similar to FIG. 1 but additionally illustrates use of an accessory reading lamp attachment.
Figure 6:
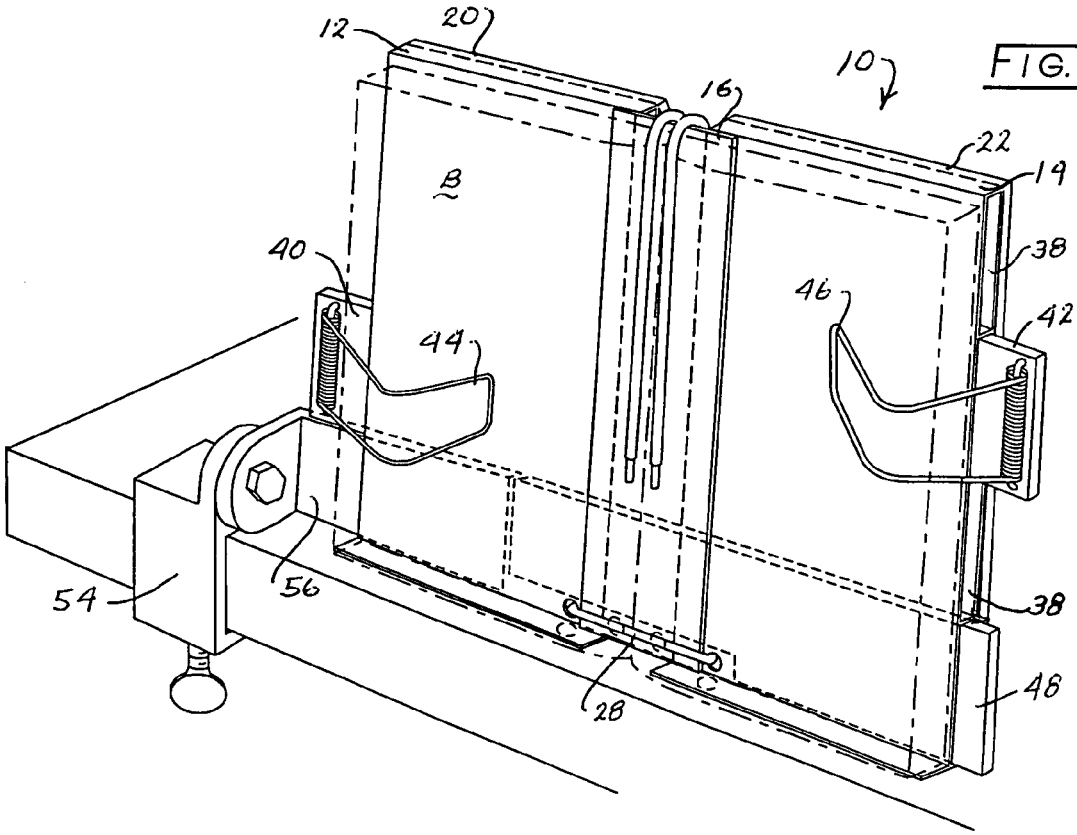
FIG. 6 is similar to FIG. 1 but illustrates the book holder assembly in use with an accessory clamping device.

As illustrated in FIGS. 1 through 3, the book holder assembly of the present invention is referenced generally by the numeral 10, and is principally comprised of a pair of spaced-apart book support elements 12 and 14, a book spine support element 16 that is positioned intermediate support elements 12 and 14 and that joins those elements together with integrally formed "live" hinges positioned along lines 15 and 18, respectively, a pair of spaced-apart holder planar angularity support elements 20 and 22 that are each joined to the top of a respective book support element also by an integrally molded "live" hinge element along lines 24 and 26, and a flexible multi-purpose cord element 28 that, using the adjustably positioned cord clamp element 30 to form a closed loop having an adjustable equivalent diameter depending upon where the clamp element is positioned on the cord, is used to achieve control of the adjustable reading slope of assembly 10. The integrally molded "live" hinge elements may be replaced with equivalent mechanical hinges but with added complexity and difficulty of manufacture. Also, book support ledges 34 and 36 are molded integral with book support elements 12 and 14. An eyelet opening 32 is positioned near each bottom edge of each of said pair of spaced-apart book holder planar book support elements 12 and 14 and near the bottom edge of the book holder planar angularity support elements 20 and 22. Referring to FIGS. 1, 4 and 6, it may be seen that the eyelets may be positioned in the lowermost inner corner of each of elements 12, 14, 20, and 22 for threaded co-operation with the slope control cord element 28. Eyelet openings 32 also may be positioned in spine support element 16 and in book support ledges 34 and 36 near each bottom edge of each of said pair of spaced-apart book holder planar book support elements 12 and 14, as illustrated in dashed lines in FIGS. 1 and 6. From this it may been seen that the exact position of the eyelets 38 in the book support elements 12 and 14 is unimportant. Additionally, the eyelets 38 may be positioned on the spine support element 16 alone.

Note from FIGS. 1, 4, and 6 that cord element 28 by being provided with a length appreciably greater than necessary to adjust the reading slope of assembly 10 to a desired slope condition can be further used as a bookmark device by having the cord excess end length looped over the holder assembly and positioned between specific book pages.

Book support elements 12 and 14 are each provided on their reverse side with a series of four integrally-molded and attached accessory insert through-pockets that are each referenced by the numeral 38 in the drawings. Each such accessory insert through-pocket 38 is sized in cross-section to receive a complementary molded accessory insert that may be slidably and adjustably positioned in the pocket 38 and that provides the assembly with any one of several different added functional capabilities. For instance, adjustable accessory inserts 40 and 42 each are provided with an affixed and formed coiled torsion spring page holder 44 or 46, the free looped end of which contacts an uppermost open page of the book B. A slidable accessory insert stay 48 is made of sufficient length that it will co-operate with a pair of opposed insert through-pockets 38 in book support elements 12 and 14, respectively, and thus provide assembly 10 with a device for maintaining the assembly in a flat open condition during use.

Although in the preferred embodiment of the instant invention an angularity support element 20 and 22 is pivotally connected to each of the book support elements 12 and 14, it is necessary that only one book support element 12 and 14 have an angularity support element 20 and 22 pivotally connected thereto in order to provide an angular support for the book holder assembly 10. With this configuration, cord element 28 would pass through a pair of eyelets positioned near each bottom edge of each of a pair of spaced-apart book holder book support elements and through a single eyelet in a single book spine support element pivotally connected to one of the book support elements.

As a general proposition I prefer to mold the principal non-cord components of assembly 10 of thermoplastic resin having substantial rigidity in the cured condition such as a polypropylene resin or the like.

FIG. 3 illustrates book holder assembly 10 in a fully closed condition. In this regard, complete closure is effected by use of the torsion spring page holders 44 and 46 in an overlapping deployment.

FIG. 4 illustrates book holder assembly 10 with an accessory electrical reading lamp 50 attached to removable insert 52 and installed in an assembly pocket 38 of book support element 14. FIG. 6, on the other hand, illustrates the book holder assembly with a clamp element 54 mounted on insert member 56 received in a pocket 38 of book support element 12 and positioned to be rigidly secured to a table top.

Figure 5:
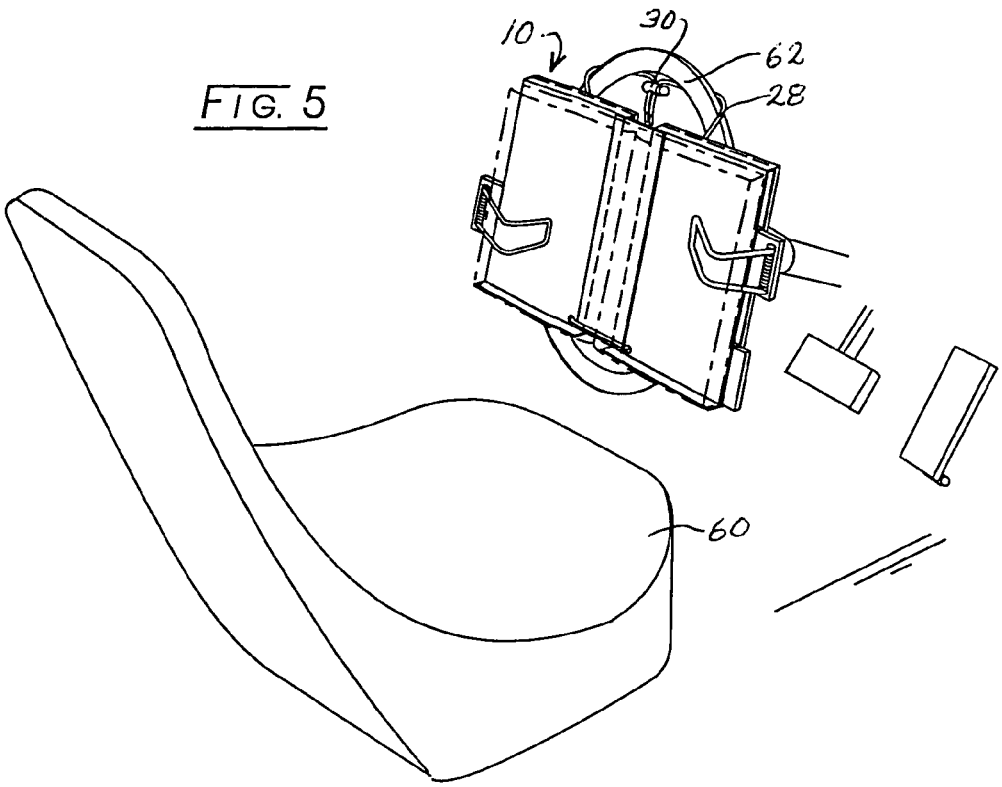
FIG. 5 illustrates use of the FIG. 1 book holder assembly in a position of use in an automotive vehicle.

FIG. 5 illustrates the manner whereby assembly 10 may be utilized to support a book for reading while positioned in the driver's seat 60 in a non-moving conventional automobile. As shown in that illustration, it is only necessary to expand the closed loop of cord element 28 by adjustment of the position of clamp element 30 on that cord so that sufficient loop exists to be partially engaged over the vehicle steering wheel 62 as shown. In such configuration reading slope is controlled by the slope of the vehicle steering wheel and not by the angular separation of angularity support elements 20 and 22 relative to book support elements 12 and 14.

Various changers may be made to the configuration, size, relative proportions, and materials of construction of the different invention elements disclosed and described herein without departing from the scope, meaning, or intent of the claims which follow.

I claim as my invention:

1. A book holder assembly for holding an open book mounted therein at a desired book reading slope, comprising:

a pair of spaced-apart book holder planar book support elements each having opposed longitudinal side edges and opposed transverse bottom and top edges;

a book holder book spine support element having longitudinal edges and joined at each said longitudinal edge by a hinge to a respective longitudinal side edge of one of said pair of spaced-apart book holder planar book support elements;

a pair of spaced apart book holder angularity support elements each having longitudinal side edges and transverse bottom and top edges and each joined at its said transverse top edge by a hinge to a respective top edge of one of said pair of spaced-apart book holder planar book support elements;

an eyelet positioned near each bottom edge of each of said pair of spaced-apart book holder planar book support elements and of each of said pair of spaced apart book holder angularity support elements; and a flexible cord threaded through said eyelets and provided with a co-operating adjustably positioned clamp to form a cord closed loop of desired effective diameter that limits the slope of said pair of book holder planar book support elements to the desired book reading slope.

2. The book holder assembly invention of claim 1, and wherein said flexible cord has sufficient extra length beyond said closed loop whereby said flexible cord extra length may also be looped over the book holder assembly to function as a book mark.

3. The invention defined by claim 1, and wherein each of said pair of book holder planar book support elements is provided with multiple accessory insert through-pockets positioned on and attached to its reverse side, said accessory insert through pockets of each book holder planar book support element abutting each other and extending between said longitudinal edges of the book holder planar book support element.

4. The invention defined by claim 3, and further comprised of a pair of accessory insert page holder elements, each said accessory insert page holder insert element slidably co-operating with one of said multiple abutting accessory insert through-pockets in a respective one of said pair of book holder planar book support elements.

5. The invention defined by claim 4, and wherein each of said accessory insert page holder elements is provided with a curved page contact element, said curved page contact element being mounted on said accessory insert page holder element with a spring that urges said curved page contact element to yieldably press against said book holder planar book support element.

6. The invention defined by claim 5, and wherein each of said book holder accessory insert page holder elements is offset longitudinally with respect to the other along said book holder book support longitudinal edges.

7. The invention defined by claim 1 and further comprised of a pair of spaced-apart book support ledges, each of said book support ledges being integrally formed with the bottom edge of a respective book holder assembly planar book support element.

8. The invention defined by claim 7 wherein said eyelet positioned near each bottom edge of each of said pair of spaced-apart book holder planar book support elements is positioned in each of said book support ledges.

9. The invention defined by claim 1 where in said eyelet positioned near each bottom edge of each of said pair of spaced-apart book holder planar book support elements is positioned in said book holder spine support element.

10. The book holder assembly invention of claim 3, wherein one accessory insert through-pocket on one of said pair of book holder planar book support elements is aligned longitudinally with another accessory insert through-pocket on the other of said pair of planar book holder support elements and an accessory insert element projects through said one and another accessory insert through-pockets to thereby retain said pair of book holder book planar book support elements in an open position.

11. A book holder assembly for holding an open book mounted therein at a desired book reading slope, comprising:

a pair of spaced-apart book holder planar book support elements each having opposed longitudinal side edges and opposed transverse bottom and top edges;

a book holder book spine support element having longitudinal edges and joined at each said longitudinal edge by a hinge to a respective longitudinal side edge of one of said pair of spaced-apart book holder planar book support elements;

a book holder angularity support element having longitudinal side edges and transverse bottom and top edges and joined at its said transverse top edge by a hinge to a respective top edge of one of said pair of spaced-apart book holder planar book support elements;

an eyelet positioned near a bottom edge of one of said pair of spaced-apart book holder planar book support elements and said book holder angularity support element; and a flexible cord threaded through said eyelets and provided with a co-operating adjustably positioned clamp to form a cord closed loop of desired effective diameter that limits the slope of said pair of book holder planar book support elements to the desired book reading slope.

12. The book holder assembly invention of claim 11, and wherein said flexible cord has sufficient extra length beyond said closed loop whereby said flexible cord extra length may also be looped over the book holder assembly to function as a book mark.

13. The invention defined by claim 11, and wherein each of said pair of book holder planar book support elements is provided with multiple accessory insert through-pockets positioned on and attached to its reverse side, said accessory insert through pockets of each book holder planar book support element abutting each other and extending between said longitudinal edges of the book holder planar book support element.

14. The invention defined by claim 13, and further comprised of a pair of accessory insert page holder elements, each said accessory insert page holder insert element slidably co-operating with one of said multiple abutting accessory insert through-pockets in a respective one of said pair of book holder planar book support elements.

15. The invention defined by claim 14, and wherein each of said accessory insert page holder elements is provided with a curved page contact element, said curved page contact element being mounted on said accessory insert page holder element with a spring that urges said curved page contact element to yieldably press against said book holder planar book support element.

16. The invention defined by claim 15, and wherein each of said book holder accessory insert page holder elements is offset longitudinally with respect to the other along said book holder book support longitudinal edges.

17. The invention defined by claim 11 and further comprised of a pair of spaced-apart book support ledges, each of said book support ledges being integrally formed with the bottom edge of a respective book holder assembly planar book support element.

18. The invention defined by claim 17 wherein said eyelet positioned near a bottom edge of one of said pair of spaced-apart book holder planar book support elements is positioned in said book support ledge.

19. The invention defined by claim 11 where in said eyelet positioned near a bottom edge of one of said pair of spaced-apart book holder planar book support elements is positioned in said book holder spine support element.

20. The book holder assembly invention of claim 13, wherein one accessory insert through-pocket on one of said pair of book holder planar book support elements is aligned longitudinally with another accessory insert through-pocket on the other of said pair of planar book holder support elements and an accessory insert element projects through said one and another accessory insert through-pockets to thereby retain said pair of book holder book planar book support elements in an open position.

* * * * *